US005778540A

United States Patent [19]

Huang

[11] Patent Number: 5,778,540

[45] Date of Patent: Jul. 14, 1998

[54] PROTECTIVE PAD FOR SCISSORS OR THE LIKE

[76] Inventor: Te Chien Huang, No. 6, Avenue 32, Lane 300, Sec. 2, Ching Hai Road, Taichung, Taiwan

[21] Appl. No.: 813,229

[22] Filed: Mar. 7, 1997

[51] Int. Cl.[6] ..... B26B 13/20

[52] U.S. Cl. ..... 30/232; 30/254; 81/427.5

[58] Field of Search ..... 30/232, 254, 231, 30/291, 298; 81/177.3, 427.5

[56] References Cited

FOREIGN PATENT DOCUMENTS 2249577 4/1974 Germany ..... 30/340

*Primary Examiner*—Douglas D. Watts

[57] ABSTRACT

A tool includes a pair of levers having a middle portion pivotally coupled together at a pivot shaft and having a pair of blades formed in one end and having a pair of handles formed in the other end. The handles each includes an opening having a peripheral surface for engaging with a ring which may engage with and may protect the fingers of the user. The handles each includes a peripheral rib for engaging with the peripheral grooves of the rings and for securing the rings to the handles.

1 Claim, 3 Drawing Sheets

PROTECTIVE PAD FOR SCISSORS OR THE LIKE

BACKGROUND OF THE INVENTION

1. Field of the Invention

The present invention relates to a pad, and more particularly to a protective pad for scissors or the like.

2. Description of the Prior Art

Typical scissors and shears comprise a pair of levers pivotally coupled together at a middle portion and having a pair of blades formed on one end and having a pair of handles formed in the other end. The handles may each include an opening for engaging with the fingers of the user. However, the hand may be hurt and may feel pain after long term of using the tool.

The present invention has arisen to mitigate and/or obviate the afore-described disadvantages of the conventional scissors or shears.

SUMMARY OF THE INVENTION

The primary objective of the present invention is to provide a protective pad for scissors or shears for protecting the hand of the user.

In accordance with one aspect of the invention, there is provided a tool comprising a pair of levers including a middle portion pivotally coupled together at a pivot shaft and including a first end having a pair of blades and including a second end having a pair of handles, the handles each including an opening having a peripheral surface, a first ring engaged with the peripheral surface of a first of the handles, and a second ring engaged with the peripheral surface of a second of the handles for engaging with thumb.

The handles each includes a peripheral rib formed in the peripheral surface, the first and the second rings each includes a peripheral groove for engaging with the peripheral rib and for securing the first and the second rings to the handles.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
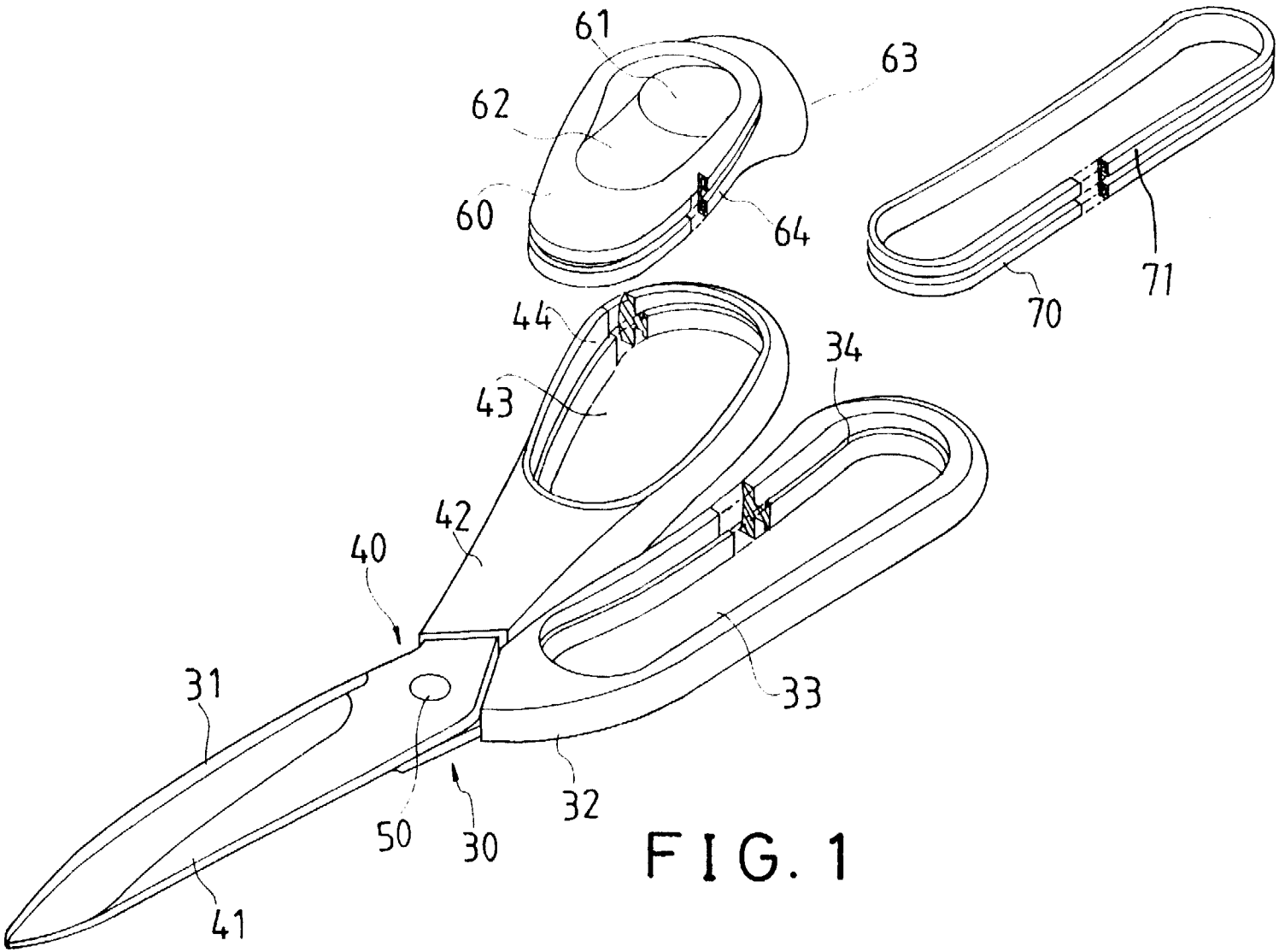
FIG. 1 is an exploded view of a protective pad in accordance with the present invention.
Figure 2:
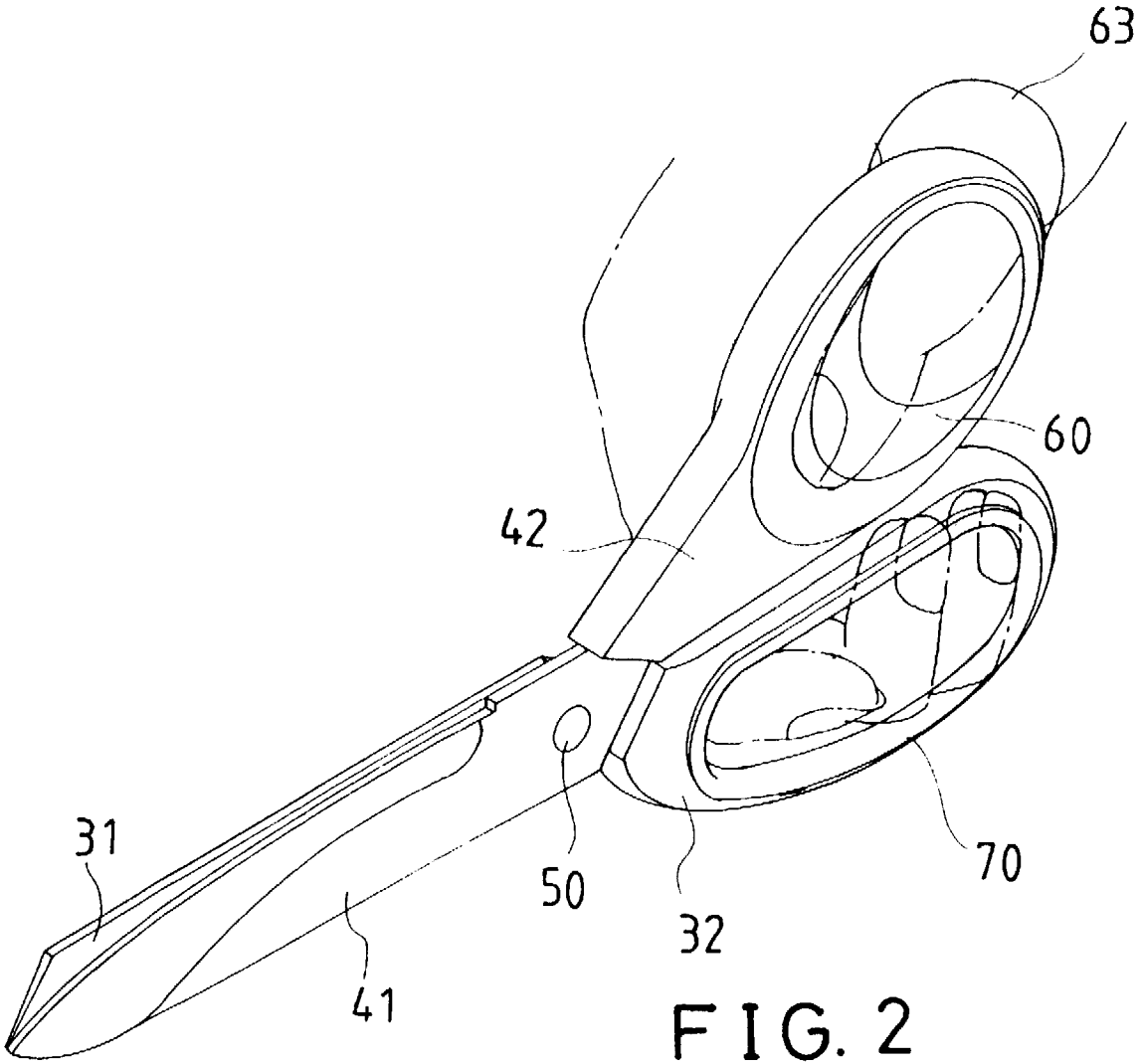
FIGS. 2 and 3 are perspective views illustrating the application of the protective pad.

Referring to the drawings, and initially to FIGS. 1 and 2, a pair of scissors or shears typically include a pair of levers

Figure 3:
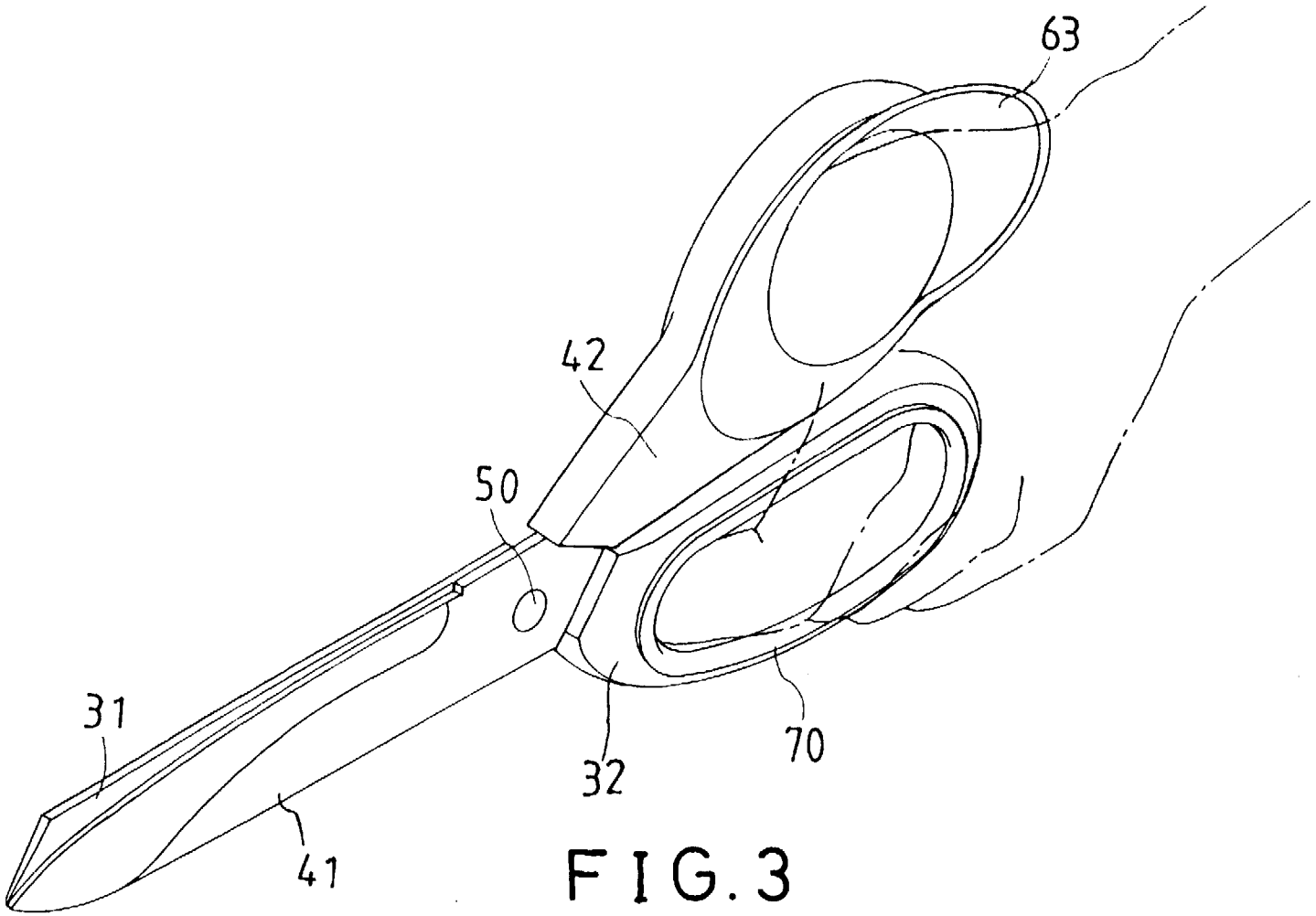

30, 40 having a middle portion pivotally coupled together at a pivot shaft 50 for forming a pair of blades 31, 41 in one end and for forming a pair of handles 32, 42 in the other end. The handles 32, 42 each includes an opening 33, 43 for engaging with fingers and having a peripheral rib 34, 44 formed in the inner peripheral surface of the opening 33, 43. The protective pad in accordance with the present invention comprises a ring 70 including a peripheral groove 71 formed in the outer portion for engaging with the peripheral rib 34 for engaging with and for protecting the fingers of the user. Another ring 60 includes a peripheral groove 64 formed in the outer peripheral portion for engaging with the peripheral rib 44 for engaging with and for protecting the thumb of the user (FIGS. 2, 3). The ring 60 includes an orifice 61 and a tapered surface 62 and a cap 63 for engaging with and for protecting the thumb.

In operation, as shown in FIGS. 2 and 3, the ring 60 may be engaged in either side for engaging with the thumb of either the right handed person (FIG. 2) or the left handed person (FIG. 3).

Accordingly, the protective pad includes two rings engaged in the handles of the scissors or shears for protecting the fingers of the user.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool comprising:

a pair of levers including a middle portion pivotally coupled together at a pivot shaft and including a first end having a pair of blades and including a second having a pair of handles, said handles each including an opening having a peripheral surface, said handles each including two sides, and said handles each including a T-shaped peripheral rib formed in said peripheral surface, a first ring engaged with said peripheral surface of a first of said handles, and a second ring engaged with said peripheral surface of a second of said handles for engaging with thumb, said first and said second rings each including a peripheral groove for engaging with said T-shaped peripheral rib and for securing said first and said second rings to said handles, said first and said second rings being adapted to be secured to said handles from either of said two sides of said handles for engaging with the hand of either the right handed person or the left handed person.

* * * * *